US005333844A

United States Patent [19]

Holcombe et al.

[11] Patent Number: 5,333,844

[45] Date of Patent: Aug. 2, 1994

[54] NON-GRAPHITE CRUCIBLE FOR HIGH TEMPERATURE APPLICATIONS

[75] Inventors: Cressie E. Holcombe, Knoxville; William A. Pfeiler, Norris, both of Tenn.

[73] Assignee: Martin Marietta Energy Systems, Inc., Oak Ridge, Tenn.

[21] Appl. No.: 951,742

[22] Filed: Sep. 25, 1992

[51] Int. Cl.[5] ..... C21B 3/00

[52] U.S. Cl. ..... 266/275; 266/286; 432/262; 432/265

[58] Field of Search ..... 266/275, 280, 286; 432/262, 263, 264, 265

[56] References Cited

U.S. PATENT DOCUMENTS

| | | | |
|---|---|---|---|
| 2,472,456 | 6/1949 | Anicetti | 263/48 |
| 2,532,389 | 12/1950 | Batcheller | 91/12.2 |
| 2,842,353 | 7/1958 | Priola | 266/39 |
| 2,854,048 | 9/1958 | Cunningham | 150/0.5 |
| 4,131,265 | 12/1978 | McCray | 266/275 |
| 4,403,955 | 9/1983 | Sarno | 432/158 |
| 4,492,572 | 1/1985 | Linn | 432/263 |
| 4,609,425 | 9/1986 | Mateika et al. | 156/617 |
| 4,687,646 | 8/1987 | Mateika et al. | 422/248 |
| 4,708,326 | 11/1987 | Brockmeyer et al. | 266/275 |

OTHER PUBLICATIONS

J. Libsch and L. Capalong, "Use of Susceptors in Induction Heating", High Frequency Heating Review, pp. 3–8, 11. Dec. 1988.

C. E. Holcombe, Jr., N. L. Dykes, and D. R. Masters, "Noncarbon Furnace for Vacuum Induction Melting of Uranium and Its Alloys", Journal of Nuclear Materials 160 (Dec. 1988) pp. 98–100.

C. E. Holocombe, Jr., R. H. Reiner, and N. L. Dykes, "Use of Tribocor 532N For A Carbon-Free Induction Furnace For Vacuum-Induction Melting and Casting of Uranium And Its Alloys", Journal of Materials Science Letters 6 (Dec. 1987) pp. 1353–1355.

*Primary Examiner*—Scott Kastler

*Attorney, Agent, or Firm*—Ivan L. Ericson; Harold W. Adams

[57] ABSTRACT

A multi-piece crucible for high temperature applications comprises a tubular side wall member having a lip on the inside surface and a bottom member or members forming a container for containing a melt of a material during a high temperature melt-casting operations. The multi-piece design prevents cracking of the crucible or leakage of the melt from the crucible during the melt-casting operation. The lip of the tubular member supports the bottom member. The contacting surfaces where the lip of the tubular side wall member contacts the bottom member of the multi-piece crucible contains a ceramic sealing material. The ceramic sealing material forms a seal sufficient to prevent the melt of the material from leaking out of the multi-piece crucible during the melt-casting process. The multi-piece crucible is made of a material which is chemically inert to the melt and has structural integrity at the melting point temperature of the melt, or of a material coated with such a material.

24 Claims, 6 Drawing Sheets

NON-GRAPHITE CRUCIBLE FOR HIGH TEMPERATURE APPLICATIONS

This invention was made with Government support under contract DE-AC05-84OR21400 awarded by the U.S. Department of Energy to Martin Marietta Energy Systems, Inc. and the Government has certain rights in this Invention.

FIELD OF THE INVENTION

The present invention relates to a crucible, more particularly, to a crucible for high temperature applications.

BACKGROUND OF THE INVENTION

Large non-graphite crucibles utilized for melting high melting point materials have a tendency to crack during the melt-casting process because of excessive mechanical stresses that develop within the crucible due to nonuniform heating of the crucible. The cracks occur primarily at the juncture of the bottom and the side wall of the crucible as well as radial cracks emanating from the center of the crucible bottom. The larger the crucible the more susceptible it is to cracking. It is desirable to reduce the labor and energy costs of the melt-casting process by reducing the time required to complete the process and to maximize the service life of the crucible. Therefore, it is very important to provide a non-graphite crucible which will not crack during the melt-casting cycle of the material. In addition, carbon contamination caused by the crucibles used in reactive melt processing is a serious problem. Therefore, it is important to prevent such contamination.

OBJECTS OF THE INVENTION

Accordingly, it is an object of the present invention to provide a non-graphite crucible for high temperature applications which will not crack or leak during the melting processing of a high melting point material.

Further and other objects of the present invention will become apparent from the description contained herein.

SUMMARY OF THE INVENTION

In accordance with one aspect of the present invention, a new and improved multi-piece crucible for high temperature applications comprises a tubular member and a bottom member. The tubular member has a centerline, an inner side wall, a lower portion, a thickness, and a lip. The lip is located on the inner side wall of the lower portion of the tubular member. The lip has a tapered side tapered in a downward direction toward the centerline of the tubular member. The bottom member has an outer side tapered in an upward direction toward the tubular member at an angle that provides a matching fit with the tapered side of the lip for enclosing the lower portion of the tubular member to form the crucible for containing a melt of a material in high temperature casting operations. The outer side of the bottom member contacts the tapered side of the lip to form a seal sufficient to contain a melt of a material used in high temperature casting operations. The lip of the tubular member supports the bottom member. The crucible or a coating on the crucible is made of a material chemically inert to the melt and has structural integrity at the melting point temperature of the melt.

In accordance with another aspect of the present invention, a new and improved multi-piece crucible for high temperature applications comprises a tubular member and a bottom member. The tubular member has a centerline, an inner side wall, a lower portion, a thickness, and a lid. The lip is located on the inner side wall of the lower portion of the tubular member. The lip has a tapered side tapered in a downward direction toward the centerline of the tubular member. The bottom member has an outer side tapered in an upward direction toward the tubular member at an angle that provides a matching angle with the tapered side of the lip for enclosing the lower portion of the tubular member to form the crucible for containing a melt of a material in high temperature casting operations. The outer side of the bottom member contacts a ceramic sealing material and the tapered side of the lip contacts the ceramic sealing material to form a seal sufficient to contain melts of materials used in high temperature casting operations. The lip of the tubular member supports the bottom member. The crucible or a coating on the crucible is made of a material chemically inert to the melt and has structural integrity at the melting point temperature of the melt.

In accordance with another aspect of the present invention, a new and improved multi-piece crucible for high temperature applications comprises a tubular member and a bottom member. The tubular member has an inner side wall a lower portion, and a lip. The lip is located on the inner side wall of the lower portion of the tubular member. The lip has a side and a top portion. The bottom member has an outer side and a bottom portion. The outer side of the bottom member has a periphery. The inner side wall has a periphery. The periphery of the outer side of the bottom member is smaller than the periphery of the inner side wall. The bottom portion of the bottom member contacts the lower portion of the tubular member to form a seal sufficient to contain a melt of a material used in high temperature casting operations. The lip of the tubular member supports the bottom member. The crucible or a coating on the crucible is made of a material chemically inert to the melt and has structural integrity at the melting point temperature of the melt.

In accordance with another aspect of the present invention, a new and improved multi-piece crucible for high temperature applications comprises a tubular member and a bottom member. The tubular member has an inner side wall, a lower portion, and a lip. The lip is located on the inner side wall of the lower portion of the tubular member. The lip has a side and a top portion. The bottom member has a side and a bottom portion. The lip of the tubular member supports the bottom member. The side of the bottom member contacts a ceramic sealing material and the side of the lip contacts the ceramic sealing material to form a seal sufficient to contain melts of materials used in high temperature casting operations. The crucible or a coating on the crucible is made of a material chemically inert to the melt and has structural integrity at the melting point temperature of the melt.

In accordance with another aspect of the present invention, a new and improved multi-piece crucible for high temperature applications utilizing large diameter crucibles comprises a multi-piece crucible having more than two pieces. The crucible comprises a tubular member and two bottom members, a first bottom member and a second bottom member. The second bottom member fits inside the first bottom member. The tubular member has a centerline, an inner side wall, a lower portion, a thickness, and a lip. The lip is located on the inner side wall of the lower portion of the tubular member. The lip has a tapered side tapered in a downward direction toward the centerline of the tubular member. The first bottom member has an outer side and an inner side. The outer side of the first bottom member is tapered in an upward direction toward the tubular member at an angle that provides a matching fit with the tapered side of lip. The inner side of the first bottom member is tapered in a downward direction toward the centerline of the tubular member. The second bottom member has an outer side. The outer side of the second bottom member is tapered in an upward direction toward the tubular member at an angle that provides a matching fit with the inner side of the first bottom member. The first and second bottom members enclose the lower portion of the tubular member to form the multi-piece crucible for containing a melt of a material in high temperature casting operations. The outer side of the first bottom member contacts the tapered side of the lip of the tubular member and the outer side of the second bottom member contacts the inner side of the first bottom member both forming a seal sufficient to contain a melt of a material used in high temperature casting operations. The lip of tubular member supports the first bottom member and the first bottom member supports the second bottom member. The crucible or a coating on the crucible is made of a material chemically inert to the melt and has structural integrity at the melting point temperature of the melt.

For a better understanding of the present invention, together with other and further objects, advantages and capabilities thereof, reference is made to the following disclosure and appended claims.

For a better understanding of the present invention together with other and further objects, advantages and capabilities thereof, reference is made to the following disclosure and appended claims in connection with the above-described drawing.

DETAILED DESCRIPTION OF THE PREFERRED EMBODIMENTS

Ceramic crucibles are utilized for melting refractory metals and alloys in high temperature casting operations. However, ceramic materials are inherently brittle and relatively poor conductors of heat. Consequently, mechanical stress is generated during the heating cycle by temperature differentials that occur within the sidewalls and the bottom of the crucible. As a result, cracks are formed usually in the bottom of the crucible. To overcome the cracking problem the crucible of the present invention is made from more than one piece to accommodate the stresses that are generated in the crucible during the high temperature heating cycles of the melting and casting process.

Several crucible designs were prepared and tests were run to evaluate the effectiveness of the concept of a multi-piece crucible to solve the cracking problems encountered with single-piece crucibles.

Figure 1:
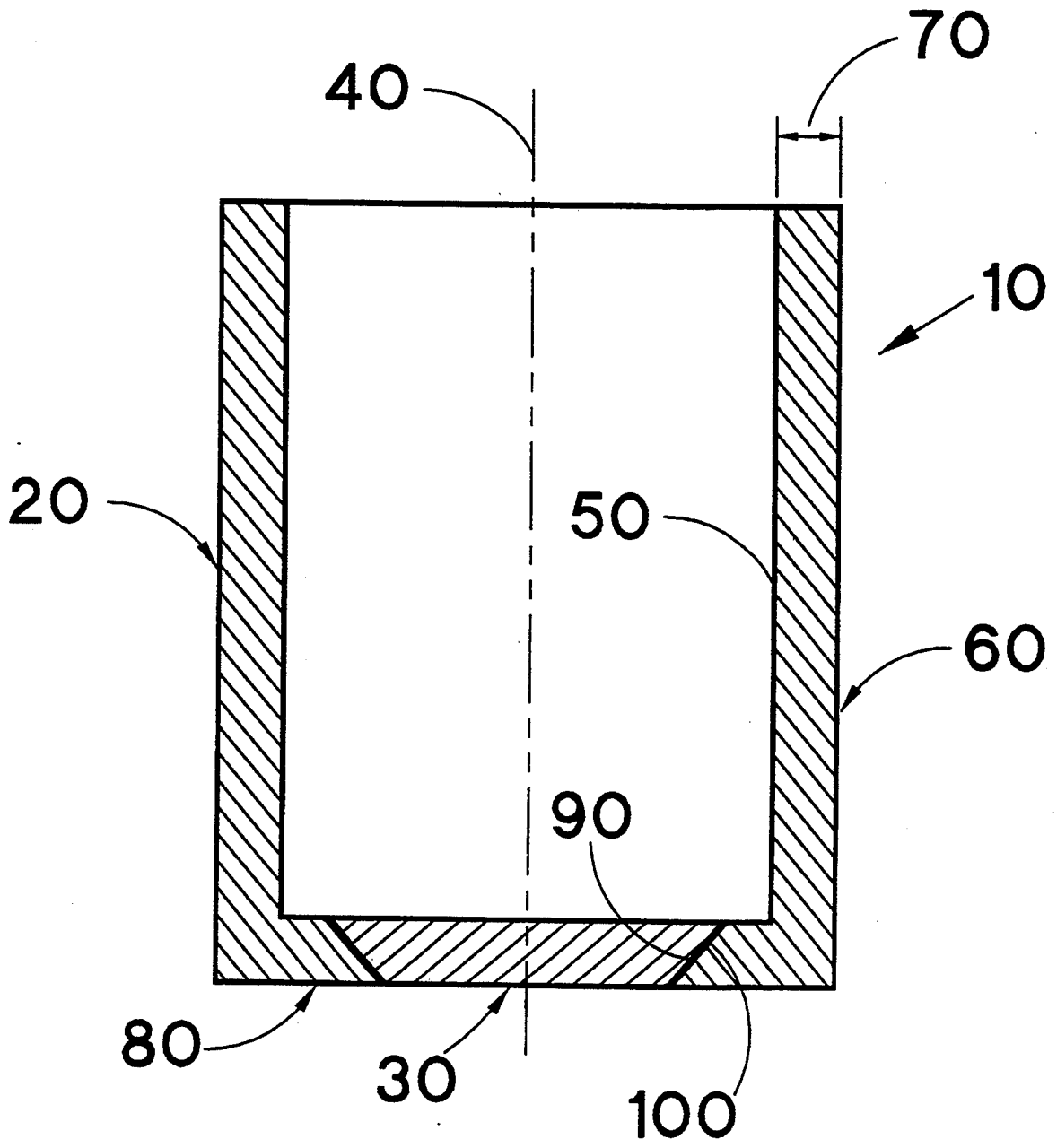
FIG. 1 is cross-sectional view an embodiment of a multi-piece crucible in accordance with the present invention.

Shown in FIG. 1 is a cross-sectional view of one embodiment of the present invention. Crucible 10 comprises tubular member 20 and bottom member 30. Tubular member 20 has centerline 40, inner side wall 50, lower portion 60, thickness 70, and lip 80. Lip 80 is located on inner side wall 50 of Lower portion 60 of tubular member 20. Lip 80 has tapered side 90 tapered in a downward direction toward centerline 40 of tubular member 20. Bottom member 30 has outer side 100 tapered in an upward direction toward tubular member 20 at an angle that provides a matching fit with tapered side 90 of lip 80 for enclosing lower portion 60 of tubular member 20 to form crucible 10 for containing a melt of a material in high temperature casting operations. Outer side 100 of bottom member 30 contacts tapered side 90 of lip 80 to form a seal sufficient to contain a melt of a material used in high temperature casting operations. Lip 80 of tubular member 20 supports bottom member 30.

Figure 2:
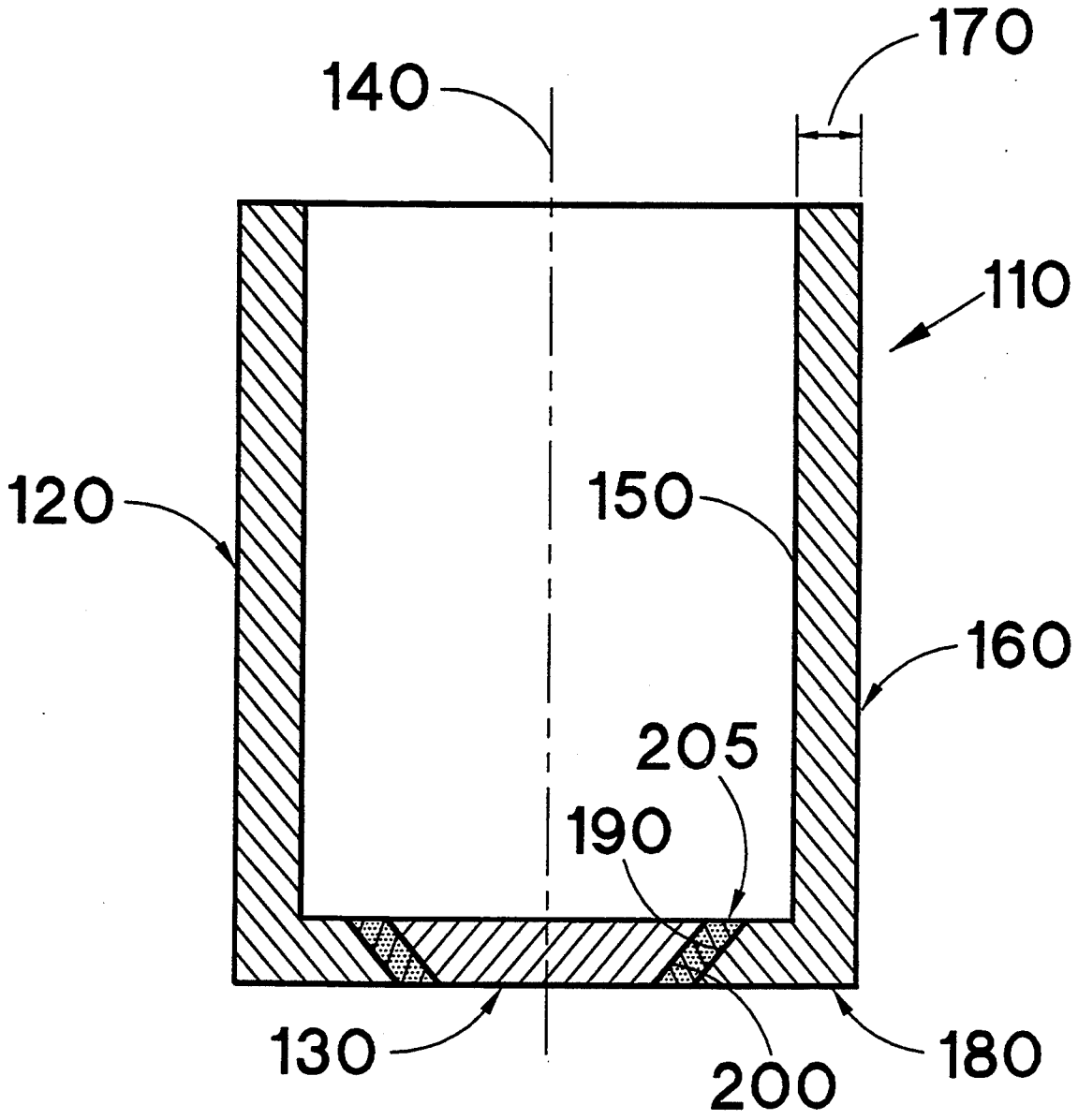
FIG. 2 is a cross-sectional view of another embodiment of a multi-piece crucible in accordance with the present invention.

Shown in FIG. 2 is another embodiment of the present invention. Crucible 110 comprises tubular member 120 and bottom member 130. Tubular member 120 has centerline 140, inner side wall 150, lower portion 160, thickness 170, and lip 180. Lip 180 is located on inner side wall 150 of lower portion 160 of tubular member 120. Lip 180 has tapered side 190 tapered in a downward direction toward centerline 140 of tubular member 120. Bottom member 130 has outer side 200 tapered in an upward direction toward tubular member 120 at an angle that provides a matching angle with tapered side 190 of lip 180 for enclosing lower portion 160 of tubular member 120 to form crucible 110 for containing a melt of a material in high temperature casting operations. Outer side 200 of bottom member 130 contacts ceramic sealing material 205 and tapered side 190 of lip 180 also contacts ceramic sealing material 205 to form a seal sufficient to contain a melt of a material used in high temperature casting operations. Lip 180 of tubular member 120 supports bottom member 130.

Figure 3:
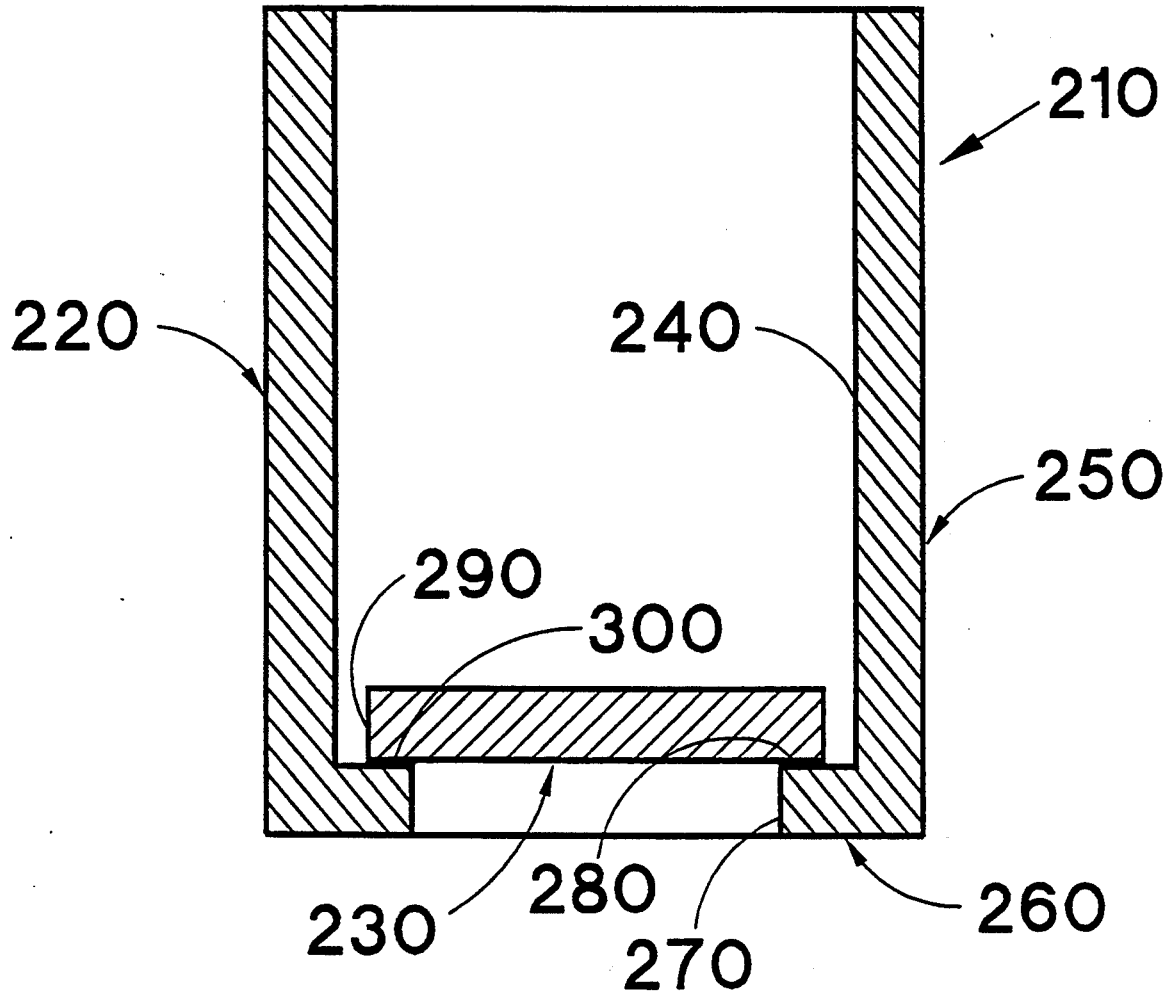
FIG. 3 is cross-sectional view of another embodiment of a multi-piece crucible in accordance with the present invention.

Shown in FIG. 3 is a further embodiment of the present invention. Crucible 210 comprises tubular member 220 and bottom member 230. Tubular member 220 has inner side wall 240, lower portion 250, and lip 260. Lip 260 is located on inner side wall 240 of lower portion 250 of tubular member 220. Lip 260 has side 270 and top portion 280. Bottom member 230 has outer side 290 and bottom portion 300. Outer side 290 of bottom member 230 has a periphery. Inner side wall 240 has a periphery. The periphery of outer side 290 of bottom member 230 is smaller than periphery of inner side wall 240. Bottom portion 300 of bottom member 230 contacts lower portion 280 of lip 260 to form a seal sufficient to contain a melt of a material used in high temperature casting operations. Lip 260 of tubular member 220 supports bottom member 230.

Figure 4:
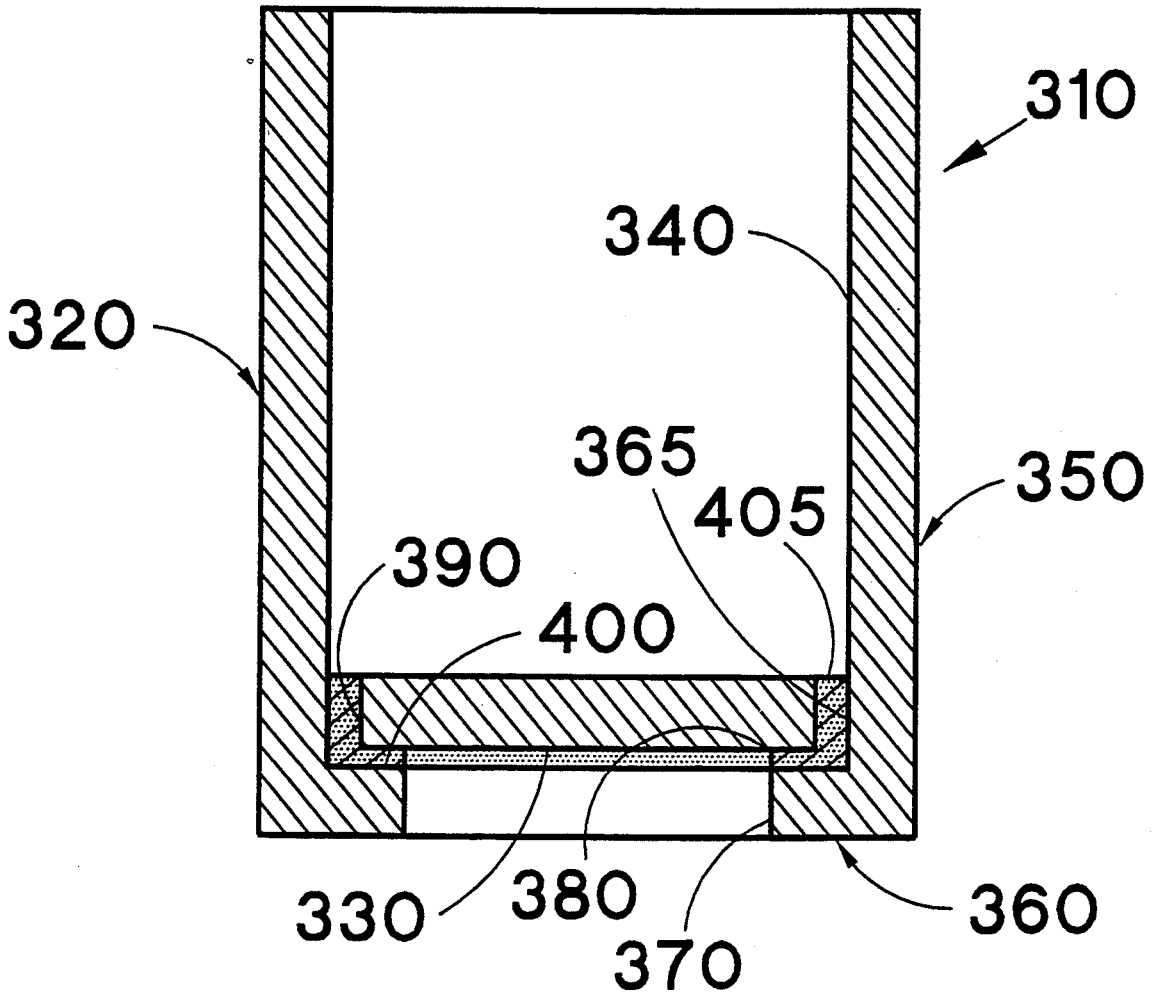
FIG. 4 is a cross-sectional view of another embodiment of a multi-piece crucible in accordance with the present invention.

Shown in FIG. 4 is still another embodiment of the present invention. Crucible 310 comprises tubular member 320 and bottom member 330. Tubular member 320 has inner side wall 340, lower portion 350, and lip 360. Inner side wall 340 of tubular member 320 has lower wall portion 365. Lip 360 is located on inner side wall 340 of lower portion 350 of tubular member 320. Lip 360 has side 370 and top portion 380. Bottom member 330 has side 390 and bottom portion 400. Bottom portion 400 and side 390 of bottom member 330 contacts ceramic sealing material 405 and top portion 390 of lip 380 and lower wall portion 365 of inner side wall 340 contacts ceramic sealing material 405 to form a seal sufficient to contain melts of materials used in high temperature casting operations. Lip 360 of tubular member 320 supports bottom member 330.

Figure 5:
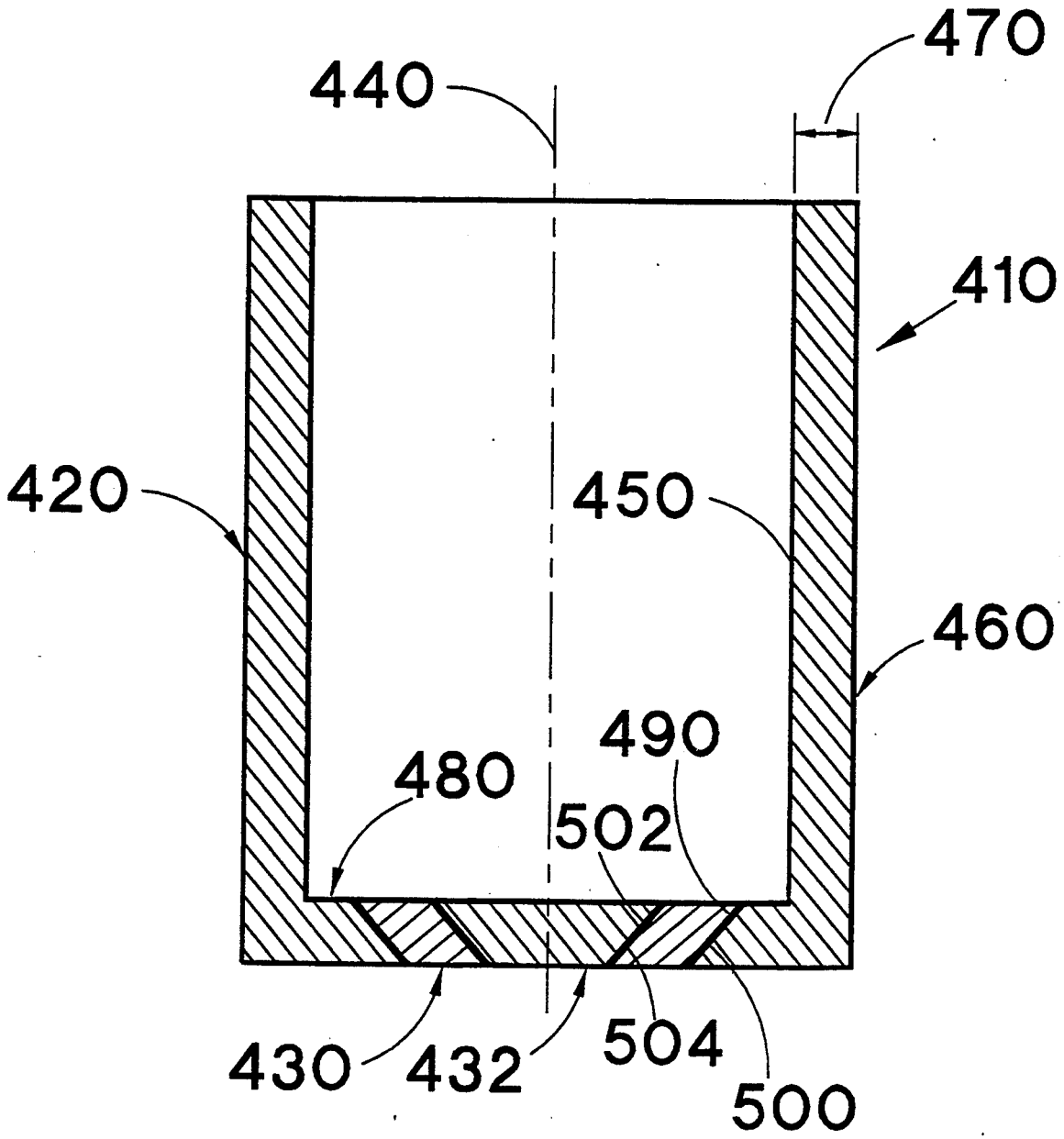
FIG. 5 is a cross-sectional view of another embodiment of a multi-piece crucible in accordance with the present invention.

Large multi-piece crucibles of the present invention can have more than two pieces. Shown in FIG. 5 is a cross-sectional view of one embodiment of a large multi-piece crucible of the present invention. Crucible 410 comprises tubular member 420 and bottom members 430 and 432. Tubular member 420 has centerline 440, inner side wall 450, lower portion 460, thickness 470, and lip 480. Lip 480 is located on inner side wall 450 of lower portion 460 of tubular member 420. Lip 480 has tapered side 490 tapered in a downward direction toward centerline 440 of tubular member 420. Bottom member 430 has outer side 500 and inner side 502. Outer side 500 is tapered in an upward direction toward tubular member 420 at an angle that provides a matching fit with tapered side 490 of lip 480. Inner side 502 of bottom member 430 is tapered in a downward direction toward centerline 440 of tubular member 420. Bottom member 432 has outer side 504. Outer side 504 of bottom member 432 is tapered in an upward direction toward tubular member 420 at an angle that provides a matching fit with inner side 502 of bottom member 430. Outer side 500 of bottom member 430 contacts tapered side 490 of lip 480 and outer side 504 of bottom member 432 contacts inner side 502 of bottom member 430. The contacts of outer side 500 of bottom member 430 with tapered side 490 of lip 480 and outer side 504 of bottom member 432 with inner side 502 of bottom member 430 form a seal sufficient to contain a melt of a material used in high temperature casting operations. Lip 480 of tubular member 420 supports bottom member 430 and bottom member 430 supports bottom member 432.

Figure 6:
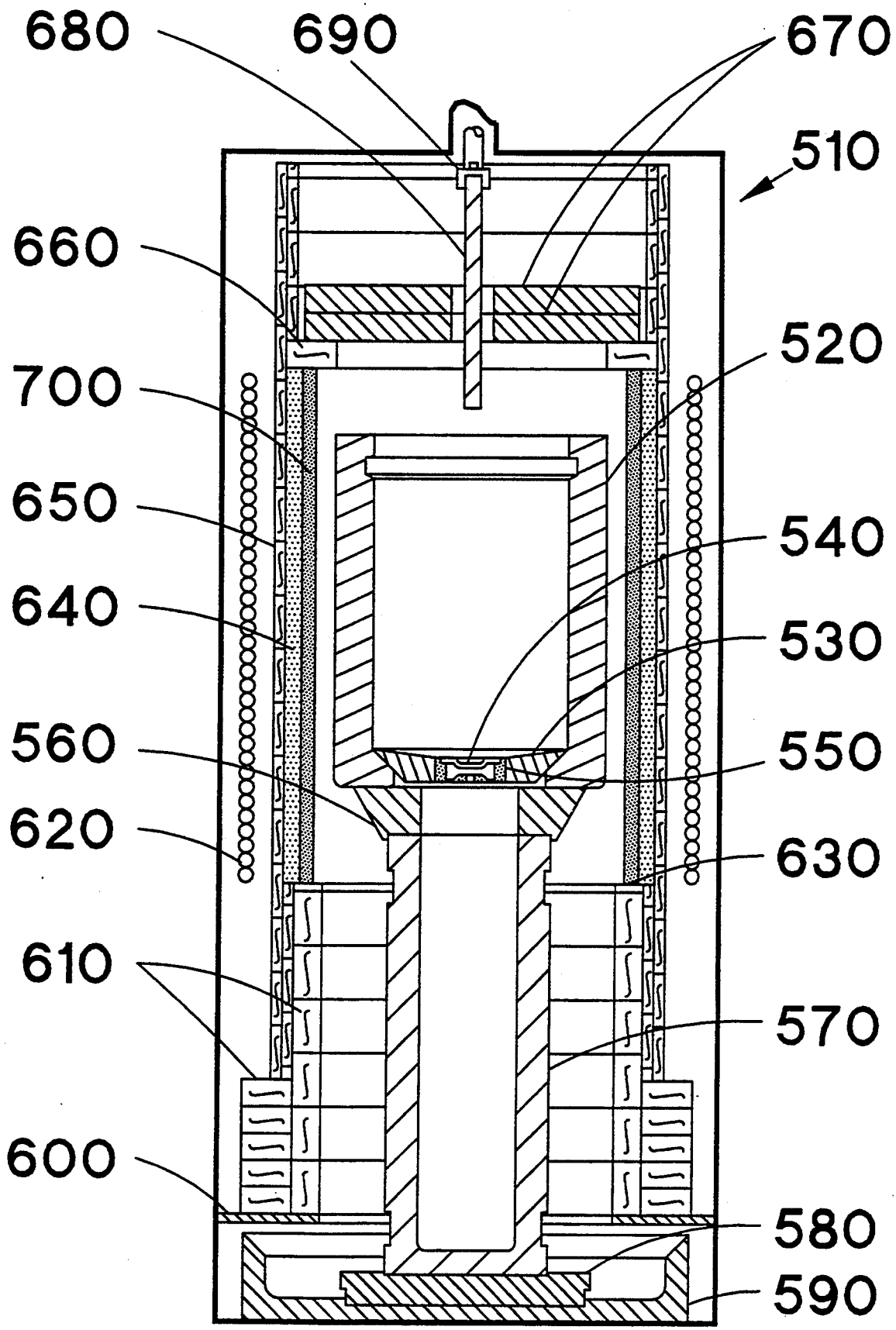
FIG. 6 is a cross-sectional view of a multi-piece crucible in accordance with the present invention installed in a furnace.

Shown in FIG. 6 is furnace 510 for making melt-casting metals and alloys. The refractory compositions used in the stack typically have melting points greater than 1650° C. Furnace 510 contains cast refractory materials: ceramic crucible 520, ceramic bottom insert 530, ceramic rupture disc 540, ceramic pour plug 550 all sitting on ceramic transition ring 560 which is sitting on ceramic billet mold 570 which is setting on nesting stack plate 580 which is setting on ceramic spill dish 590. Furnace 510 comprises steel base support 600, alumina bricks 610, susceptor coil 620, ceramic susceptor support ring 630, bubble zirconia insulation 640, 1425° C.–1650° C. firebrick 650, top alumina brick 660, molded 1650° C. insulating lid 670, ceramic pour rod 680, pour rod connector 690, and plasma sprayed tungsten susceptor 700.

Several tests were run to check the effectiveness of different multi-piece crucible designs and materials of construction.

Large multi-piece ceramic crucibles with sizes ranging from 19" OD, 23" high to 30" OD, 22" high were successfully tested. The typical wall thickness of the crucibles ranged from $1\frac{7}{8}$ to 2".

EXAMPLE I

A two-piece crucible of graphite was prepared by bonding a graphite tubular sidewall piece with a graphite bottom piece with a ceramic sealing material. The bonding was accomplished by coating the tapered side of the lip of the sidewall of the tubular sidewall piece and the tapered side of the bottom piece with a paste-like ceramic sealing material consisting of yttria mingled in an aqueous solution of sodium carboxymethyl cellulose and upon drying formed a seal and bond between the graphite tubular side wall piece and the graphite bottom piece of the two-piece crucible. The graphite bottom piece has a pour plug seated on a ledge-insert in the center of the graphite bottom section to facilitate the discharge of the melt into a mold upon the melting of the material charged in the crucible.

The two-piece crucible was painted with an yttria wash coat, dried and then loaded with 180 kilograms of depleted uranium and placed in a vacuum furnace. The loaded crucible was heated in a vacuum to a temperature of 1315° C. and held for 0.5 hour to melt the depleted uranium. Then, the molten charge of depleted uranium was poured into a casting mold.

Examination of the two-piece crucible after the charge was poured out of the crucible indicated that none of the uranium charge had leaked from the crucible and that the crucible was free of cracks.

The test also indicated that the seal between the bottom piece and the tubular sidewall piece of the crucible held and no leakage of the molten charge was evident.

EXAMPLE II

A two-piece crucible was fabricated from a ceramic material containing the following constituents: 48 wt.% silicon carbide; 48 wt.% aluminum oxide; and 4 wt.% silicon oxide. The tapered side of the crucible bottom piece and the tapered side of the lip of the tubular sidewall piece were sealed together with the paste-like ceramic sealing material described in Example I and coated as described in Example I.

The two-piece crucible was loaded with 120 to 240 kilograms of uranium-2 wt.% niobium alloy and processed through a casting operation as described in Example I. Except, the alloy was heated to a temperature of 1385° C. in the casting operation with a six hour run time. A total of 12 melt/cast tests were run with the two-piece crucible. The two-piece crucible was examined for cracks and leaks after each test. These examinations indicated that none of the uranium alloy had leaked from the crucible and that the crucible was free of cracks. Consequently, the stresses created in one-piece ceramic crucibles by temperature differences during heating cycles can be alleviated by using the multi-piece crucible of the present invention.

EXAMPLE III

A two-piece crucible was fabricated using a different refractory ceramic material for the bottom plate. The tubular sidewall piece with the lip was fabricated from graphite and the bottom piece was fabricated from a refractory material containing the following constituents: 50 wt.% niobium; 30 wt.% titanium; and 20 wt. % tungsten. The bottom piece was then heavily nittided by heat treating at about 1600° C. to about 1850° C. in nitrogen. The tapered side of the lip of the tubular sidewall piece and the tapered side of the bottom piece were sealed with a paste-like ceramic sealing material consisting of titanium nitride mingled in an aqueous solution of carboxymethyl cellulose and the assembled crucible was coated as described in Example I.

The two-piece crucible was loaded with uranium-2 wt.% niobium alloy and processed through a casting operation as described in Example II. Examination of the crucible after the casting operation indicated that none of the uranium-2 wt.% niobium alloy leaked from the crucible and that the crucible tubular sidewall piece and the bottom piece were free of cracks.

Crucibles having bottom pieces 20" in diameter did not crack. The tubular side wall piece of the crucible works best if it is as close to being a free-standing cylinder as possible. The preferred crucible design seems to be the small-ledge crucible design rather than the "valve seat" design. However, all the variations tested worked well: valve seat long taper, valve seat truncated taper on housing, small-ledge, clover-leaf taper all work to reduce thermally induced stresses and prevent crucible cracking.

One of the causes of crucible cracking is the use of a cylindrical susceptor to drive the heat into and through the crucible to the charge of material to be melted. The susceptor can be graphite, plasma-sprayed tungsten, molybdenum (i.e., a riveted, dove-tailed interlocking solid ¼" thick metallic molybdenum susceptor worked well), or any refractory metal or conductor. The susceptor picks up the induction field and heats. The heat is transmitted, generally by radiation (or convection if argon or other gas is used for the environment; by radiation alone in vacuum) to the crucible and charge. Since the susceptor designs are right-circular cylinders that are larger in diameter than the crucibles, the heat is transmitted to the outer diameter of the crucible where it is conducted through to the inside of the crucible. The charge is heated by radiation from the inner wall of the crucible and through the bottom by conduction. However, the bottom middle of the crucible is the farthest from the heat-source susceptor and thus is the last to heat, generally very sluggish in attaining temperature. The studies indicate that cracking occurs very early in the heating cycle, while the interior is cool and the outside is several hundreds of degrees higher in temperature, creating a large temperature differential, delta T, from the outside wall to the center of the crucible. Generally the multi-piece crucible prevents the temperature differential from causing enough stress to crack or break the crucible. During the heating cycle the tubular side wall of the crucible expands, and the bottom piece slides on the ledge or sloped section, thereby reducing or eliminating any stress caused by the expansion.

With single piece crucibles cracking usually occurs a the point where the bottom of the crucible meets the side wall of the crucible and/or radial cracks emanating from the center of the crucible bottom.

The use of silicon carbide-loaded ceramics (essentially mullite-aluminum oxide formulations loaded with silicon carbide) will reduce the temperature differentials, since the combination of a good thermal conductor (silicon carbide) with the poorly conducting oxide ceramic yields a better overall thermal conductor, thus reducing the temperature differentials. However, high-alumina compositions (such as the 92.5 to 95% alumina, remainder silica) appear to still work well in the multi-piece crucibles; thus, if, for some reason, silicon carbide is not desired, it is not required. Silicon carbide materials react with oxides in vacuum to yield silicon monoxide at 1450° to 1550° C., limiting the upper use-temperature utility in vacuum to about 1500° C. with those materials.

A multi-piece crucible made from a refractory metal alloy composition was tested. The refractory metal alloy called Tribocor 532N, a trademark of Fansteel, Inc., is a nitrided refractory metal alloy consisting essentially of 50 wt.% titanium, 30% niobium, and 20% tungsten, generally nitrided at 1875° C. for 4 hours to yield a surface of titanium nitride. The Tribocor 532N is a heavily nitrided metal (1.6 mm nitride-affected depth, with 0.25 mm of a mostly nitride outer layer consisting mostly of titanium nitride). In the initial test a straight edged (nontapered) Tribocor bottom piece having a thermal expansion similar to alumina, $8\times10^{-6}$/°C. was used with a graphite tubular side wall piece having a straight edged lip and a thermal expansion of about $4\times10^{-6}$/°C. The graphite tubular side wall piece broke, spilling the melt and damaging the Tribocor bottom piece, when the crucible was heated. The bottom piece was repaired by brazing and the edge was tapered. The Tribocor bottom piece having the tapered edge was then tested with a graphite tubular side wall piece having a tapered lip which matched the tapered edge of the bottom piece. A ceramic sealing paste used for this test comprised a binder/suspension of 50 wt.% titanium nitride powder in an aqueous solution of 6 wt.% sodium carboxymethyl cellulose. The multi-piece crucible using the tapered edges worked well, with no cracks developing or spilling of the melted material. This test demonstrates that the tapered edges "valve seat" arrangement works well for a multi-piece crucible utilizing materials with dissimilar thermal expansions for the crucible bottom and tubular side wall.

The ceramic sealing paste used for grouting the pieces of the multi-piece crucible together is a precaution to insure the molten material will not leak out of the crucible during the melting operation when melting materials which have a low viscosity and a high density.

One of the ceramic sealing pastes used comprises a binder/suspension of 50 wt.% yttrium oxide powder in a aqueous solution of 6 wt.% sodium carboxymethyl cellulose. The ceramic sealing paste is used for sealing areas between the pieces of the multi-piece crucibles. For very large gaps, the yttria based paste can be modified by adding zirconia bubbles (typically 1/16" in diameter) as a filler. The ceramic sealing paste forms a layer of weakly-bonded yttria particles that allows movement of the joined sections while not sintering to a hard, dense ceramic. The dried paste is easily scraped off after a run if needed. Generally, however, the joined sections can be reused as is by applying another coating of ceramic sealing paste without any further changes.

The multi-piece crucible system allows vacuum induction melting of reactive metals without the use of graphite components. There is no known production scale graphite-free system for induction melting/casting reactive metals (including specialty steels, titanium and titanium alloys, zirconium and zirconium alloys, beryllium and beryllium alloys, or uranium and uranium alloys). The multi-piece crucible enables these reactive metals to be processed by vacuum induction melting, a standard, economical technique that is used for less-reactive metals and alloy materials that can utilize graphite. The uniqueness of the non-graphite multi-piece crucible is that it withstands thermal stresses that must be withstood when the process cycle time is minimized in order for vacuum induction melting to be economically competitive on a production basis. Additionally, the multi-piece crucible can be readily substituted for graphite in normal vacuum induction melting operations. For alloys that react with carbon or graphite, there has been no alternative but to arc melt them, a very expensive processing method compared to vacuum induction melting. Thus the present invention opens up the reactive metal melting/casting area for utilization of standard, economical vacuum induction melting.

Other materials can be combined to provide nonreactive surfaces for containing a specific material during induction-heating operations. For example, silicon carbide at levels of to 85 wt.% can be combined with ceramic oxides (primarily alumina with some silica) to improve the thermal conductivity of the ceramics for induction heating operations. Various materials for the construction of the multi-piece crucibles were used in the tests. For example the tubular side wall piece and the bottom piece of the non-graphite crucibles were made from a material selected from the group comprising graphite; silicon carbide; ceramic composition comprising 48 wt.% silicon carbide, 48 wt.% aluminum oxide, and 4 wt.% silicon oxide; ceramic composition comprising 90% alumina and 9.5% silicon dioxide; ceramic composition comprising 61.5% alumina, 33% silicon carbide, and 4.7% silicon dioxide; ceramic composition comprising 48% alumina, 48% silicon carbide, and 4% silicon dioxide; ceramic composition comprising 35% alumina, 59% silicon carbide, and 5% silicon dioxide; ceramic composition comprising 29.4% alumina, 67.5% silicon carbide, and 3.7% silicon dioxide; and refractory metal alloy composition from Fansteel, Inc. called Tribocor 532N comprising 50% niobium, 30% titanium and 20% tungsten in which the outer layer of the piece made from such composition consisted essentially of titanium nitride and combinations thereof. Consequently, a crucible of the present invention can be used for heating specialty steels, titanium metal and titanium alloys, zirconium metal and zirconium alloys, and beryllium metal and beryllium alloys.

The multiple-piece crucible can be utilized in the induction-melting of uranium metal and uranium alloys. Usually, induction melting operations are more efficient than arc-melting operations. Also, the multiple-piece crucible can lessen the carbon contamination of uranium metal and uranium alloys during casting operations. As a result, the recycle of uranium scrap can be increased and waste minimization would be enhanced.

In addition, a multiple-piece crucible of the present invention can be used in casting specialty steels, titanium metal and titanium alloys, zirconium metal and zirconium alloys, and beryllium metal and beryllium alloys.

While there has been shown and described what is at present considered the preferred embodiments of the invention, it will be obvious to those skilled in the art that various changes and modifications may be made therein without departing from the scope of the invention as defined by the appended claims.

What is claimed is:

1. A multi-piece crucible for containing a melt of a material for high temperature applications comprising: a tubular member and a bottom member, said tubular member having a centerline, an inner side wall, a lower portion, a thickness, and a lip, said lip being located on said inner side wall of said lower portion of said tubular member, said lip having a tapered side tapered in a downward direction toward said centerline of said tubular member, said bottom member having an outer side tapered in an upward direction toward said tubular member at an angle that provides a matching fit with said tapered side of said lip for enclosing said lower portion of said tubular member to form said crucible for containing said melt of said material in high temperature casting operations, said outer side of said bottom member contacting said tapered side of said lip forming a seal sufficient to contain said melt of said material used in said high temperature casting operations, said lip of said tubular member supporting said bottom member, said crucible being made of a material chemically inert to said melt and having structural integrity at the melting point temperature of said melt.

2. A crucible in accordance with claim 1 wherein said crucible is made from a non-graphite containing material.

3. A crucible in accordance with claim 1 wherein said tubular side wall member is made from a material selected from the group consisting of silicon carbide; ceramic composition comprising 48 wt.% silicon carbide, 48 wt.% aluminum oxide, and 4 wt.% silicon carbide, ceramic composition comprising 90% alumina and 9.5% silicon dioxide; ceramic composition comprising 61.1% alumina, 33% silicon carbide, and 4.7% silicon dioxide; ceramic composition comprising 48% alumina, 48% silicon carbide, and 4% silicon dioxide; ceramic composition comprising 35% alumina, 59% silicon carbide, and 5% silicon dioxide; and ceramic composition comprising 29.4% alumina, 67.5% silicon carbide, and 3.7% silicon dioxide; and refractory metal alloy composition comprising 50% niobium, 30% titanium and 20% tungsten in which the outer layer of said piece made from said refractory metal alloy composition consists essentially of titanium nitride and combinations thereof.

4. A crucible in accordance with claim 1 wherein said bottom member is made from a material selected from the group consisting of silicon carbide; ceramic composition comprising 48 wt.% silicon carbide, 48 wt.% aluminum oxide, and 4 wt.% silicon oxide; ceramic composition comprising 90% alumina and 9.5% silicon dioxide; ceramic composition comprising 61.5% alumina, 33% silicon carbide, and 4.7% silicon dioxide; ceramic composition comprising 48% alumina, 48% silicon carbide, and 4% silicon dioxide; ceramic composition comprising 35% alumina, 59% silicon carbide, and 5% silicon dioxide; and ceramic composition comprising 29.4% alumina, 67.5% silicon carbide, and 3.7% silicon dioxide; and refractory metal alloy composition comprising 50% niobium, 30% titanium and 20% tungsten in which the outer layer of said pieces made from said refractory metal alloy composition consists essentially of titanium nitride and combinations thereof.

5. A multi-piece crucible for containing a melt of a material for high temperature applications comprising: a tubular member and a bottom ember, said tubular member having a centerline, an inner side wall, a lower portion, a thickness, and a lip, said lip being located on said inner side wall of said lower portion of said tubular member, said lip having a tapered side tapered in a downward direction toward said centerline of said tubular member, said bottom member having an outer side tapered in an upward direction toward said tubular member at an angle that provides a matching angle with said tapered side of said lip for enclosing said lower portion of said tubular member to form said crucible for containing said melt of said material in high temperature casting operations, said outer side of said bottom member contacting a ceramic sealing material and said tapered side of said lip contacting said ceramic sealing material forming a seal sufficient to contain said melt of said material used in high temperature casting operations, said lip of said tubular member supporting said bottom member, said crucible being made of a material chemically inert to said melt and having structural integrity at the melting point temperature of said melt.

6. A crucible in accordance with claim 5 wherein said crucible is made from a non-graphite containing material.

7. A crucible in accordance with claim 5 wherein said tubular side wall member is made from a material selected from the group consisting of silicon carbide; ceramic composition comprising 48 wt.% silicon carbide, 48 wt. % aluminum oxide, and 4 wt.% silicon oxide; ceramic composition comprising 90% alumina and 9.5% silicon dioxide; ceramic composition comprising 61.5% alumina, 33% silicon carbide, and 4.7% silicon dioxide; ceramic composition comprising 48% alumina, 48% silicon carbide, and 4% silicon dioxide, ceramic composition comprising 35% alumina, 59% silicon carbide, and 5% silicon dioxide; and ceramic composition comprising 29.4% alumina, 67.5% silicon carbide, and 3.7% silicon dioxide; and refractory metal alloy composition comprising 50% niobium, 30% titanium and 20% tungsten in which the outer layer of said pieces made from said refractory metal alloy composition consists essentially of titanium nitride and combinations thereof.

8. A crucible in accordance with claim 5 wherein said bottom member is made from a material selected from the group consisting of silicon carbide; ceramic composition comprising 48 wt.% silicon carbide, 48 wt.% aluminum oxide, and 4 wt.% silicon oxide; ceramic composition comprising 90% alumina and 9.5% silicon dioxide; ceramic composition comprising 61.5% alumina, 33% silicon carbide, and 4.7% silicon dioxide; ceramic composition comprising 48% alumina, 48% silicon carbide, and 4% silicon dioxide; ceramic composition comprising 35% alumina, 59% silicon carbide, and 5% silicon dioxide; and ceramic composition comprising 29.4% alumina, 67.5% silicon carbide, and 3.7% silicon dioxide; and refractory metal alloy composition comprising 50% niobium, 30% titanium and 20% tungsten in which the outer layer of said pieces made from said refractory metal alloy composition consists essentially of titanium nitride and combinations thereof.

9. A crucible in accordance with claim 5 wherein said ceramic sealing material is prepared by drying a ceramic sealing material comprising yttria mingled in an aqueous solution of sodium carboxymethyl cellulose.

10. A crucible in accordance with claim 5 wherein said ceramic sealing material is prepared by drying a ceramic sealing material comprising titanium nitride mingled in an aqueous solution of sodium carboxymethyl cellulose.

11. A multi-piece crucible for containing a melt of a material for high temperature applications comprising: a tubular member and a bottom member, said tubular member having an inner side wall, a lower portion, and a lip, said lip being located on said inner side wall of said lower portion of said tubular member, said lip having a side and a top portion, said bottom member having an outer side and a bottom portion, said outer side of said bottom member having a periphery, said inner side wall having a periphery, said periphery of said outer side of said bottom member being smaller than said periphery of said inner side wall, said bottom portion of said bottom member contacting said lower portion of said tubular member forming a seal sufficient to contain said melt of said material used in high temperature casting operations, said lip of said tubular member supporting said bottom member, said crucible being made of a material chemically inert to said melt and having structural integrity at the melting point temperature of said melt.

12. A crucible in accordance with claim 11 wherein said crucible is made from a non-graphite containing material.

13. A crucible in accordance with claim 11 wherein said tubular side wall member is made from a material selected from the group consisting of silicon carbide; ceramic composition comprising 48wt.% silicon carbide, 48 wt.% aluminum oxide, and 4 wt.% silicon oxide; ceramic composition comprising 90% alumina and 9.5% silicon dioxide; ceramic composition comprising 61.5% alumina, 33% silicon carbide, and 4.7% silicon dioxide; ceramic composition comprising 48% alumina, 48% silicon carbide, and 4% silicon dioxide; ceramic composition comprising 35% alumina, 59% silicon carbide, and 5% silicon dioxide; and ceramic composition comprising 29.4% alumina, 67.5% silicon carbide, and 3.7% silicon dioxide; and refractory metal alloy composition comprising 50% niobium, 30% titanium and 20% tungsten in which the outer layer of said pieces made from said refractory metal alloy composition consists essentially of titanium nitride and combinations thereof.

14. A crucible in accordance with claim 11 wherein said bottom member is made from a material selected from the group consisting of silicon carbide; ceramic composition comprising 48 wt.% silicon carbide, 48 wt.% aluminum oxide, and 4 wt.% silicon oxide; ceramic composition comprising 90% alumina and 9.5% silicon dioxide; ceramic composition comprising 61.5% alumina, 33% silicon carbide, and 4.7% silicon dioxide; ceramic composition comprising 48% alumina, 48% silicon carbide, and 4% silicon dioxide; ceramic composition comprising 35% alumina, 59% silicon carbide, and 5% silicon dioxide; and ceramic composition comprising 29.4% alumina, 67.5% silicon carbide, and 3.7% silicon dioxide; and refractory metal alloy composition comprising 50% niobium, 30% titanium and 20% tungsten in which the outer layer of said pieces made from said refractory metal alloy composition consists essentially of titanium nitride and combinations thereof.

15. A multi-piece crucible for containing a melt of a material for high temperature applications comprising: a tubular member and a bottom member, said tubular member having an inner side wall, a lower portion, and a lip, said lip being located on said inner side wall of said lower portion of said tubular member, said lip having a side and a top portion, said bottom member having a sided and a bottom portion, said lip of said tubular member supporting said bottom member, said bottom of said bottom member contacting a ceramic sealing material and said top portion of said lip contacting said ceramic sealing material forming a seal sufficient to contain said melt of said material used in high temperature casting operations, said crucible being made of a material chemically inert to said melt and having structural integrity at the melting point temperature of said melt.

16. A crucible in accordance with claim 15 wherein said crucible is made from a non-graphite containing material.

17. A crucible in accordance with claim 15 wherein said tubular side wall member is made from a material selected from the group consisting of silicon carbide; ceramic composition comprising 48 wt.% silicon carbide, 48 wt.% aluminum oxide, and 4 wt.% silicon oxide; ceramic composition comprising 90% alumina and 9.5% silicon dioxide; ceramic composition comprising 61.5% alumina, 33% silicon carbide, and 4.7% silicon dioxide; ceramic composition comprising 48% alumina, 48% silicon carbide, and 4% silicon dioxide; ceramic composition comprising 35% alumina, 59% silicon carbide, and 5% silicon dioxide; and ceramic composition comprising 29.4% alumina, 67.5% silicon carbide, and 3.7% silicon dioxide; and refractory metal alloy composition comprising 50% niobium, 30% titanium and 20% tungsten in which the outer layer of said pieces made from said refractory metal alloy composition consists essentially of titanium nitride and combinations thereof.

18. A crucible in accordance with claim 15 wherein said bottom member is made from a material selected from the group consisting of silicon carbide; ceramic composition comprising 48 wt.% silicon carbide, 48 wt.% aluminum oxide, and 4 wt.% silicon oxide; ceramic composition comprising 90% alumina and 9.5% silicon dioxide; ceramic composition comprising 61.5% alumina, 33% silicon carbide, and 4.7% silicon dioxide; ceramic composition comprising 48% alumina, 48% silicon carbide, and 4% silicon dioxide, ceramic composition comprising 35% alumina, 59% silicon carbide, and 5% silicon dioxide; and ceramic composition comprising 29.4% alumina, 67.5% silicon carbide, and 3.7% silicon dioxide; and refractory metal alloy composition comprising 50% niobium, 30% titanium and 20% tungsten in which the outer layer of said pieces made from said refractory metal alloy composition consists essentially of titanium nitride and combinations thereof.

19. A crucible in accordance with claim 15 wherein said ceramic sealing material is prepared by drying a ceramic sealing material comprising yttria mingled in an aqueous solution of sodium carboxymethyl cellulose.

20. A crucible in accordance with claim 15 wherein said ceramic sealing material is prepared by drying a ceramic sealing material comprising titanium nitride mingled in an aqueous solution of sodium carboxymethyl cellulose.

21. A large multi-piece crucible having more than two pieces for containing a melt of a material for high temperature applications comprising: tubular member and at least two bottom members, a first bottom member and a second bottom member, said tubular member having an inner side wall, a lower portion, and a lip, said lip being located on said inner side wall of said lower portion of said tubular member, said second bottom member fitting inside said first bottom member, said tubular member having a centerline, an inner side wall, a lower portion, a thickness, and a lip, said lip being located on said inner side wall of said lower portion of said tubular member, said lip having a tapered side tapered in a downward direction toward said centerline of said tubular member, said first bottom member having an outer side and an inner side, said outer side of said first bottom member being tapered in an upward direction toward said tubular member at an angle that provides a matching fit with said tapered side of said lip of said tubular member, said inner side of said first bottom member being tapered in a downward direction toward said centerline of said tubular member, said second bottom member having an outer side, said outer side of said second bottom member being tapered in an upward direction toward said tubular member at an angle that provides a matching fit with said inner side of said first bottom member, said first bottom member and said second bottom member enclosing said lower portion of said tubular member forming said crucible for containing said melt of said material in high temperature casting operations, said outer side of said first bottom member contacting said tapered side of said lip of said tubular member and said outer side of said second bottom member contacting said inner side of said first bottom member both forming a seal sufficient to contain said melt of said material used in high temperature casting operations, said lip of said tubular member supporting said first bottom member and said first bottom member supporting said second bottom member.

22. A large multi-piece crucible in accordance with claim 21 wherein said large multi-piece crucible is made from a non-graphite containing material.

23. A crucible in accordance with claim 21 wherein said tubular side wall member is made from a material selected from the group consisting of silicon carbide; ceramic composition comprising 48 wt.% silicon carbide, 48 wt.% aluminum oxide, and 4 wt.% silicon oxide; ceramic composition comprising 90% alumina and 9.5% silicon dioxide; ceramic composition comprising 61.5% alumina, 33% silicon carbide, and 4.7% silicon dioxide; ceramic composition comprising 48% alumina, 48% silicon carbide, and 4% silicon dioxide; ceramic composition comprising 35% alumina, 59% silicon carbide, and 5% silicon dioxide; and ceramic composition comprising 29.4% alumina, 67.5% silicon carbide, and 3.7% silicon dioxide; and refractory metal alloy composition comprising 50% niobium 30% titanium and 20% tungsten in which the outer layer of said pieces made from said refractory metal alloy composition consists essentially of titanium nitride and combinations thereof.

24. A crucible in accordance with claim 21 wherein said bottom member is made from a material selected from the group consisting of silicon carbide; ceramic composition comprising 48 wt.% silicon carbide, 48 wt.% aluminum, oxide, and 4 wt.% silicon oxide; ceramic composition comprising 90% alumina and 9.5% silicon dioxide; ceramic composition comprising 61.5% alumina, 33% silicon carbide, and 4.7% silicon dioxide; ceramic combustion comprising 48% alumina, 48% silicon carbide, and 4% silicon dioxide; ceramic combustion comprising 35% alumina, 59% silicon carbide, and 5silicon dioxide; and ceramic composition comprising 29.4% alumina, 67.5% silicon carbide, and 3.7% silicon dioxide; and refractory metal alloy comprising comprising 50% indium, 30% titanium and 20% tungsten in which the outer layer of said pieces made from said refractory metal alloy composition consists essentially of titanium nitride and combinations thereof.

* * * * *